United States Patent [19]

Greenwood et al.

[11] Patent Number: 4,836,605

[45] Date of Patent: Jun. 6, 1989

[54] INFLATABLE BOOSTER SEAT

[75] Inventors: Mark H. Greenwood, Arlington Heights; Alan P. Sherman, Wheeling, both of Ill.

[73] Assignee: Children On the Go, Inc., Wheeling, Ill.

[21] Appl. No.: 174,106

[22] Filed: Mar. 28, 1988

[51] Int. Cl.[4] ..... A47D 1/10

[52] U.S. Cl. ..... 297/250; 297/456; 297/DIG. 3

[58] Field of Search ..... 297/250, DIG. 3, 456

[56] References Cited

U.S. PATENT DOCUMENTS

| | | | |
|---|---|---|---|
| 2,216,818 | 10/1940 | Kuhlman | 297/DIG. 3 |
| 2,623,574 | 12/1952 | Damsch | 297/DIG. 3 |
| 2,767,408 | 10/1956 | Reibman | 297/250 X |
| 3,112,956 | 12/1963 | Schick et al. | 297/DIG. 3 |
| 3,265,438 | 8/1966 | Regan et al. | 297/380 |
| 3,455,571 | 7/1969 | Dallera et al. | 280/18 |
| 3,635,528 | 1/1972 | Strom | 297/456 |
| 3,742,526 | 7/1973 | Lillard | 297/456 |
| 4,179,158 | 12/1979 | Flaum et al. | 297/456 |
| 4,459,714 | 7/1984 | Lin | 297/DIG. 3 |
| 4,521,052 | 6/1985 | Cone | 297/250 |
| 4,547,919 | 10/1985 | Wang . | |
| 4,601,667 | 7/1986 | Hull | 297/250 X |
| 4,687,452 | 8/1987 | Hull | 441/131 |

FOREIGN PATENT DOCUMENTS

| | | | |
|---|---|---|---|
| 1905254 | 5/1971 | Fed. Rep. of Germany | 297/DIG. 3 |

*Primary Examiner*—Francis K. Zugel

*Attorney, Agent, or Firm*—Olson & Hierl

[57] ABSTRACT

A booster seat is provided having an inflatable lower portion which can be generally donut-shaped and an inflatable upper portion which can be generally U-shaped. The lower portion and the upper portion are hinged together whereby the inflated upper portion is folded over and is secured against the upper surface of the inflated lower portion to provide a seat pocket in which a child can sit.

15 Claims, 1 Drawing Sheet

INFLATABLE BOOSTER SEAT

FIELD OF THE INVENTION

The present invention relates to a booster seat that can be inflated for use and deflated for compact storage.

BACKGROUND OF THE INVENTION

Devices designed to boost children at a table are well known in the field of child safety products. When first old enough to sit independently without the aid of neck support, a child is often seated at a table in a high chair.

When a child outgrows a high chair, a booster seat may be used to raise the child to table level. The best known of these is a box-like structure which includes a seat portion having arm supports between which the child sits and is supported.

Such a device, however, has a several disadvantages. For example, the seat is quite bulky to store between uses and for travel. These booster seats are also typically made of a hard, inflexible plastic such as olypropylene and, as a result, are quite uncomfortable.

There is a need for a booster seat that is both confortable and easy to store. These features, however, must not be provided at the expense of economy because the product must also be inexpensive to manufacture. The present invention meets these needs.

SUMMARY OF THE INVENTION

The present invention relates to a booster seat that is confortable to the user and easy to store. The booster seat includes a lower portion which has a base pad that can be generally donut-shaped and is inflatable. An upper portion includes a middle section which acts as a back support and two side sections which act as arm supports. The upper portion can be generally U-shaped and is also inflatable. Moreover, the upper portion is attached to the lower portion by securing means thereby defining a seat pocket in which the user sits.

The securing means can include hinge means which connects the upper portion at its end peripheries to the lower portion at its front and a pair of flaps, one of which is connected to the middle section of the upper portion with the other being connected to the back end of the lower portion. Fastening straps connected to the arm supports can also be provided to releasably secure the booster seat to an adult chair. To use the booster seat, the upper portion is folded about the hinge means and the flaps are joined together to assemble the booster seat. The fastening straps can then be used to hold the booster seat to an adult chair.

Thus, an inexpensive, confortable, easy to store booster seat is provided by the present invention.

BRIEF DESCRIPTION OF THE DRAWINGS

In the accompanying drawings which form a part of this disclosure.

DETAILED DESCRIPTION OF A PREFERRED EMBODIMENT

Figure 1:
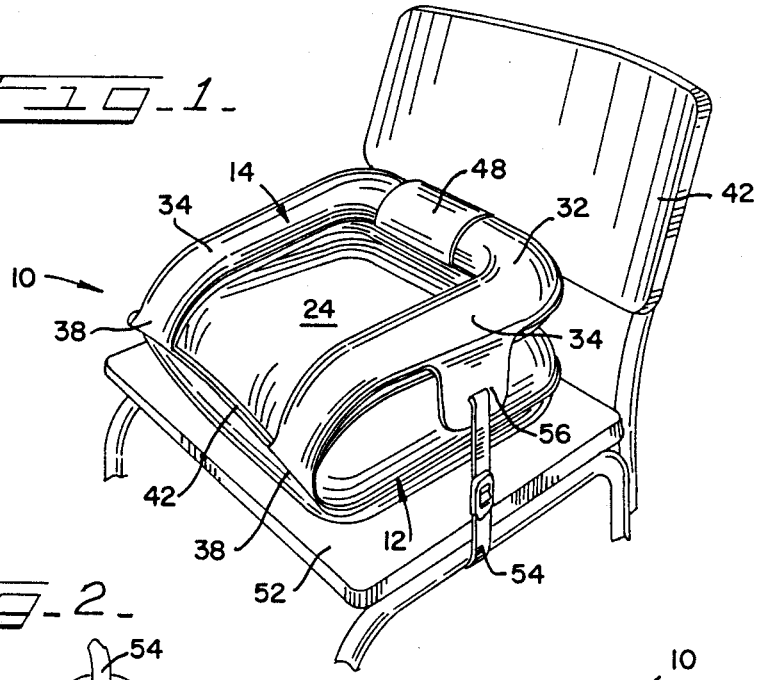
FIG. 1 is a perspective view of one embodiment of the booster seat.

Referring to FIG. 1, a preferred embodiment of a booster seat according to the present invention, which is designated generally by the reference numeral 10, is shown in an inflated and assembled form. The booster seat 10 includes a lower portion 12 and an upper portion 14.

The lower portion 12 and upper portion 14 are preferable made of a flexible fabric which is impervious to gas. The fabric must also be suffuciently strong to easily support the weight of a small child. In practice, vinyl having a thickness of about 15 mils has been found to be a satisfactory, relatively low cost material.

Figure 2:
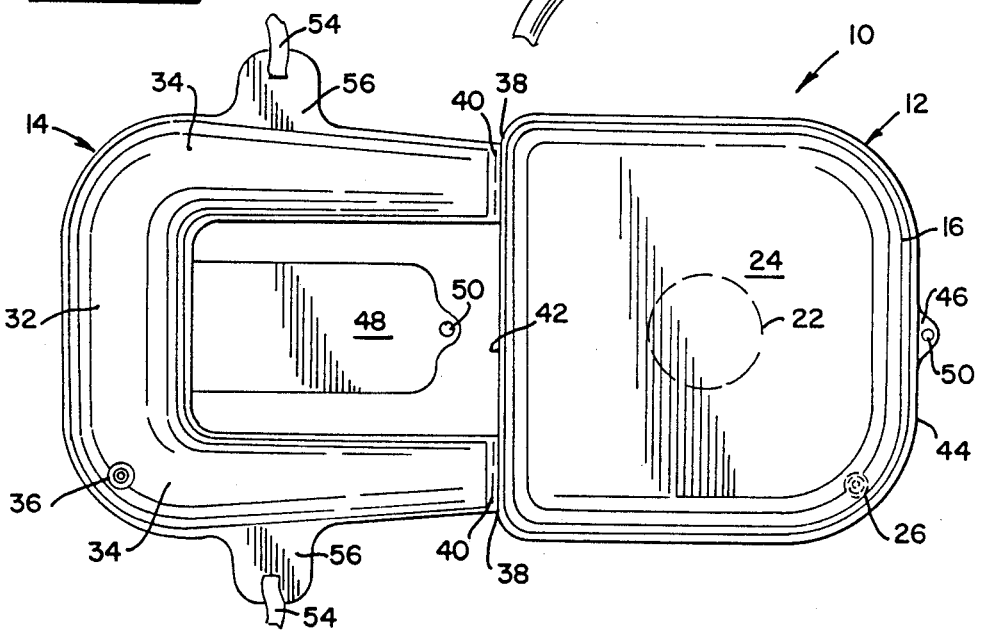
FIG. 2 is a top view of the booster seat.
Figure 3:
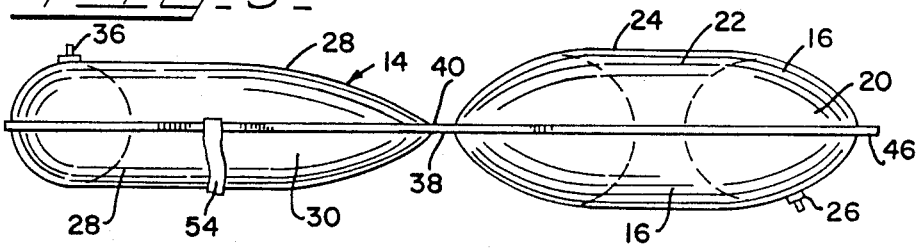
FIG. 3 is a side elevational view of the booster seat shown in FIGS. 1 and 2 assembled and ready for use.

The lower portion 12 includes two sheets 16 of such impervious fabric sealed together to define a base pad 18 which includes a gas pocket 20 (refer to FIGS. 2 and 3). The gas pocket 20 includes a central aperture 22 thus defining a generally donut-shaped base pad 18. The generally donut-shaped base pad 18 is covered with a flexible cover 24 which can preferably be a third sheet of the same impervious fabric. The flexible cover 24 thus provides a seat surface on which the child can sit and prevents objects from falling through the central aperture onto the chair.

In an alternative embodiment, the central aperture 22 can be modified and can be formed by providing a dimpled or recessed portion in the center of each sheet 16. The recessed portions can then be joined back-to-back to assist the lower portion 12 in maintaining its relatively flat, rather than spherical, shape. An air valve 26 (also shown in phantom) is provided on the underside (or at any other location) of the base pad 18 so the user can inflate the base pad 18 for use.

When the child sits on the inflated lower portion 12, the child's posterior is positioned on the flexible cover 24 over the central aperture 22 of the base pad. The central aperture 22 provides a well on which the child sits. The inflated generally donut-shaped base pad 18 thus provides circumferential support around the child to maintain stability while the child is seated on the lower portion 12.

The upper portion 14 also includes two sheets 28 of the inpervious fabric sealed together to define a second gas pocket 30. The upper portion 14 can be generally U-shaped and preferably includes a middle section 32 and a pair of side sections 34. A second air valve 36 is provided on the surface of the upper portion 14 so the user can inflate the upper portion 14 for use. When so inflated, the middle section 32 acts as a back support while the two side sections 34 act as arm supports.

Referring now to FIG. 2, a top view showing an inflated but unassembled booster seat 10 is shown. The central aperture 22 is shown in phantom surrounded by the generally donut-shaped base pad 18. The flexible cover 24 provides the seat surface and the upper portion 14 is ready for assembly.

To assemble the device, the upper portion 14 must be securely fastened against the flexible cover 24 of the lower portion 12. When fastened, the side sections 34 and middle section 32 surround three sides of the central aperture thus defining a seat pocket for the child. To this end, means for securely but releasably connecting the upper portion 14 to the lower portion 12 is provided.

In a preferred embodiment, the securing means includes hinge means 38 that connects end peripheries 40 of the side sections 34 to the lower portion 12 thereby defining a front 42 of the lower portion 12. The inflated upper portion 14 is thus rotated or swung about these hinge means 38 to properly orientate the upper portion 14 over and against the seat surface of the lower portion 12. The securing means also includes a pair of corresponding flaps.

The first flap 46 is located on the lower portion 12 opposite the front, thereby defining the back 44 of the lower portion 12. The second flap 48 is connected to the inside surface of the back support 32. In the alternative, the second flap 48 can be connected to the outside surface of the back support 32, but by connecting the flap 48 to the inside surface, the forces applied to the flap 48 when the booster seat is assembled are preferably spread over the surface of the back support 32.

To engage the flaps 46 and 48, the flap 48 must thus be folded around the back support 32. The flaps 46 and 48 are provided with corresponding connecting means 50 which can include Velcro tabs, snaps, ties or the like to hold the flaps together. Thus, a stable connection between the back support 32 and the lower portion 12 is provided.

Referring now to FIG. 3, a side view of the present booster seat 10 is shown. The upper support 14 is folded over the hinge means 38, the flap 48 is folded over the middle section 32, and the connecting means 50 of the flaps 46 and 48 are secured together. The flexible cover 24, side sections 34 and middle section 32 thus define a seat pocket in which the child sits. To further stabilize the booster seat 10, means for releasably fastening the booster seat 10 to an adult chair 52 is provided. The fastening means can include straps 54 which are attached to side flaps 56 on the arm supports 34. The straps 54 can include a connecting means such as a buckle, tab or snap to fasten the booster seat 10 to the adult chair 52.

Thus, the present invention provides a comfortable, easy to store booster seat 10. In at least two preferred methods of constructing the seat, it can be seen that the present invention is also economical.

In the first preferred method, the booster seat 10 can be made by cutting two identical patterns in the inpervious fabric. Each such pattern can include a generally donut-shaped section corresponding to the base pad 18 and a generally U-shaped portion corresponding to the upper portion 14. The generally donut-shaped section and the generally U-shaped section are connected as one integral piece at the end peripheries 40 of the side sections 34 of the generally U-shaped section.

Extending inwardly from the inside edge of the middle portion 32 of the generally U-shaped section is a rectangular piece which corresponds to the flap 48. Extending outwardly from each outside edge of the side portions 34 of the generally U-shaped sections are two generally rectangular-shaped pieces which correspond to the side flaps 56.

The generally U-shaped section of one of the patterns and the generally donut-shaped section of the second pattern include air valves. A third pattern is provided which covers the generally donut-shaped section to act as the flexible cover 24.

To assemble the booster seat 10, the outside edges of the two identical patterns are sealed together (preferably by heat sealing) to define a gas pocket 20 and the outside edge of the third pattern is sealed over the generably donut-shaped section to provide the seat surface. The generally rectangular pieces extending inwardly from the middle portion 32 of the generally U-shaoed section are sealed together to define the flap 48. The corresponding generally rectangular-shaped pieces extending outwardly from the side members 34 of the generally U-shaped section are also sealed together to define the side flaps 56.

Finally, the junction between the generally U-shaped section and the generallly donut-shaped section located at the end peripheries 40 of the side members 34 of the general U-shaped section are sealed together to define a second gas pocket 30. This sealed area thus acts as a flexible hinge means 38 which allows the inflated generally U-shaped section to be folded over the inflated generally donut-shaped section. After the additional straps are added and secured, the booster seat of the present invention is ready for use.

In a second preferred method of construction, two patterns corresponding to the generally U-shaped section are cut separately from two patterns corresponding to the generally donut-shaped sections. Again, the generally U-shaped patterns include generally rectangular pieces extending inwardly from the middle portion 32 and two generally rectangular pieces extending outwardly from the outside edge of the side portions 34. A fifth pattern corresponding to the cover sheet is also cut.

In this second embodiment, the two patterns correspnding to the generally donut-shaped portions further include two rectangular flaps on one side thereof. The generally U-shaped pattern, including the flaps 48 and side flaps 56, are sealed together. The generally donut-shaped patterns and the cover sheet pattern, including the rectangular flaps, are also sealed together. The sealed rectangular flaps on the generally donut-shaped portion are then sealed to the end periphery 40 of the generally U-shaped portion. These sealed rectangular flaps act as the flexible hinge means 38.

It should be understood that various modifications, changes and variations in addition to those herein discussed may be made in the arrangement, operation, and details of construction and assembly of the elements disclosed without departing from the spirit and scope of the invention.

What is claimed is:

1. A booster seat comprising:

an inflatable lower portion having a first flap means;

an inflatable upper portion which includes outer peripheries and an interior surface having a second flap means connected thereto; and hinge means connecting the outer peripheries of the upper portion to the lower portion whereby folding the upper portion over the hinge means and securing the first flap means to the second flap means defines a seat pocket.

2. The booster seat of claim 1 wherein the lower portion comprises an inflatable base pad that defines a central aperture thereby making the base pad generally donut-shaped.

3. The booster seat of claim 2 wherein the lower portion further includes a flexible cover secured over the base pad.

4. The booster seat of claim 1 wherein the upper portion includes a middle section defining a back support means and a pair of side sections defining arm support means.

5. The booster seat of the claim 1 further including means for fastening the booster seat to an adult chair.

6. A booster seat for use with an adult chair comprising:

a lower portion defining a seat surface and including a front and rear, the rear including a first flap means connected thereto;

an upper portion having a middle section defining a back support which includes an interior surface and a pair of side sections having end peripheries and defining arm supports, the upper portion being secured to the lower portion by hinge means connecting the end peripheries of the arm supports to the front of the lower portions; and a second flap means connected to the interior surfaces of the back support that cooperates with the first flap means to secure the upper portion over the seat surface.

7. The booster seat of claim 6 further including fastening means connected to the arm supports, the fastening means being adapted to secure the booster seat on the adult chair.

8. The booster seat of claim 6 wherein the base pad is generally donut-shaped and is inflatable.

9. the booster seat of claim 6 wherein the upper portion is generally U-shaped and is inflatable.

10. A method for installing a booster seat on an adult chair comprising:

inflating a base pad which defines a seat surface and includes a first flap means;

inflating an upper portion which includes outer peripheries and an interior surface having a second flap means connected thereto;

folding the upper portion over the base pad about hinges which connect the outer peripheries of the upper portion to the base pad;

securing the first and second flap means together to secure the base pad and the upper portion together to form the booster seat; and fastening the booster seat to an adult chair.

11. A method of manufaturing a booster seat. comprising the steps of:

cutting two sheets of impervious fabric into a generally donut-shaped portion having a first flap means and a generally U-shaped portion having an interior surface second cooperating flap means connected thereto;

sealing the edges of the generally donut-shaped portion and the generally U-shaped portion together to define a gas pocket; and sealing the generally U-shaped portion from the generally donut-shaped portion to separate the gas pocket into a generally donut-shaped gas pocket which defines a seat surface and a generally U-shaped gas pocket whereby when the generally U-shaped portion is inflated and folded at the seal between the U-shaped portion and the donut-shaped portion over the inflated generally donut-shaped portion and the first and second flap means are secured a booster seat is defined.

12. The method of claim 14 further including the steps of cutting a third sheet in the same shape as the outside edges of the generally donut-shaped portions and sealing the third sheet over the generally donut-shaped portions.

13. A method of manfacturing a booster seat comprising the steps of:

cutting two generally donut-shaped portions having a first flap means out of impervious fabric;

cutting two generally U-shaped portions having end peripheries and an interior surface having a second cooperating flap means connected thereto out of impervious fabric;

sealing the edges of the two generally donut-shaped portions together to define a gas pocket which defines a seat surface;

sealing the edges of the two generally U-shaped portions together to define a second gas pocket; and sealing the end peripheries of the generally U-shaped poritons to the generally donut-shaped portions whereby when the generally U-shaped gas pocket is inflated and folded at the seal between the end peripheries of the generally U-shaped portions and the donut-shaped portions over the generally donut-shaped gas pocket and the first and second flap means are secured a booster seat is defined.

14. The method of claim 13 further including the step of cutting a fifth portion in the same shape as the outside edges of the generally donut-shaped portions and sealing the outside edges of the fifth portion to the outside edges of the sealed generally donut-shaped portions.

15. The method of claim 13 wherein the step of providing securing means includes the step of sealing the end peripheries of the generally U-shaped patterns to the sealed generally donut-shaped patterns to define a hinge means.

* * * * *

UNITED STATES PATENT AND TRADEMARK OFFICE

CERTIFICATE OF CORRECTION

PATENT NO. : 4,836,605

DATED : June 6, 1989

INVENTOR(S) : Mark H. Greenwood and Alan P. Sherman

It is certified that error appears in the above-identified patent and that said Letters Patent is hereby corrected as shown below:

Column 1, line 18, change "has a several" to --has several--.

Column 3, line 38, change "In the first" to --In a first--.

Column 3, line 65, change "generally U-shaoed" to --generally U-shaped--.

Column 5, line 34, change "manufaturing" to --manufacturing" and change "seat." to --seat--.

Column 5, line 39, change "surface second" to --surface and a second--.

Signed and Sealed this

Thirteenth Day of February, 1990

*Attest:*

JEFFREY M. SAMUELS

*Attesting Officer*

*Acting Commissioner of Patents and Trademarks*